US012628871B2

(12) United States Patent
Batista et al.

(10) Patent No.: US 12,628,871 B2
(45) Date of Patent: May 19, 2026

(54) CARTRIDGE FOR AN AEROSOL GENERATING DEVICE

(71) Applicant: Philip Morris Products S.A., Neuchatel (CH)

(72) Inventors: Rui Nuno Batista, Neuchatel (CH); Ricardo Cali, Mannheim (DE)

(73) Assignee: Philip Morris Products S.A., Neuchatel (CH)

( * ) Notice: Subject to any disclaimer, the term of this patent is extended or adjusted under 35 U.S.C. 154(b) by 500 days.

(21) Appl. No.: 17/998,091

(22) PCT Filed: May 7, 2021

(86) PCT No.: PCT/EP2021/062138
§ 371 (c)(1),
(2) Date: Nov. 7, 2022

(87) PCT Pub. No.: WO2021/228710
PCT Pub. Date: Nov. 18, 2021

(65) Prior Publication Data

US 2023/0354891 A1 Nov. 9, 2023

(30) Foreign Application Priority Data

May 11, 2020 (EP) ..... 20173927

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/48* (2020.01); *A24F 40/51* (2020.01)

(58) Field of Classification Search
None
See application file for complete search history.

(56) References Cited

U.S. PATENT DOCUMENTS 9,420,829 B2 8/2016 Thorens et al.
2006/0054165 A1 3/2006 Hughes et al.
(Continued)

FOREIGN PATENT DOCUMENTS

CN 105595419 A 5/2016
CN 206025227 U 3/2017
(Continued)

OTHER PUBLICATIONS

Combined Chinese Office Action and Search Report issued Mar. 18, 2025 in Chinese Patent Application No. 202180033074.3 (with English Translation), 20 pages.
(Continued)

*Primary Examiner* — Phu H Nguyen
(74) *Attorney, Agent, or Firm* — Oblon, McClelland, Maier & Neustadt, L.L.P.

(57) ABSTRACT

A cartridge is provided for an aerosol-generating device, including a mouthpiece body with an outer surface and an inner air channel including an air channel inner surface and a mouthpiece opening at a mouth end of the channel and being an outlet for a first part of a flow of the aerosol accessible to a mouth of a user; a liquid reservoir; and an aerosol generator that is a heater to heat liquid from the reservoir to form an aerosol, the mouthpiece body including nasal airflow passages extending from the inner surface to the outer surface, at least one of the passages is an outlet for a second part of the flow of the aerosol accessible to the user as aroma, and the cartridge being configured to dispense the aroma through the passages driven by a puff of the user and corresponding to a frequency and intensity of the puff.

15 Claims, 5 Drawing Sheets

Figure 1A:
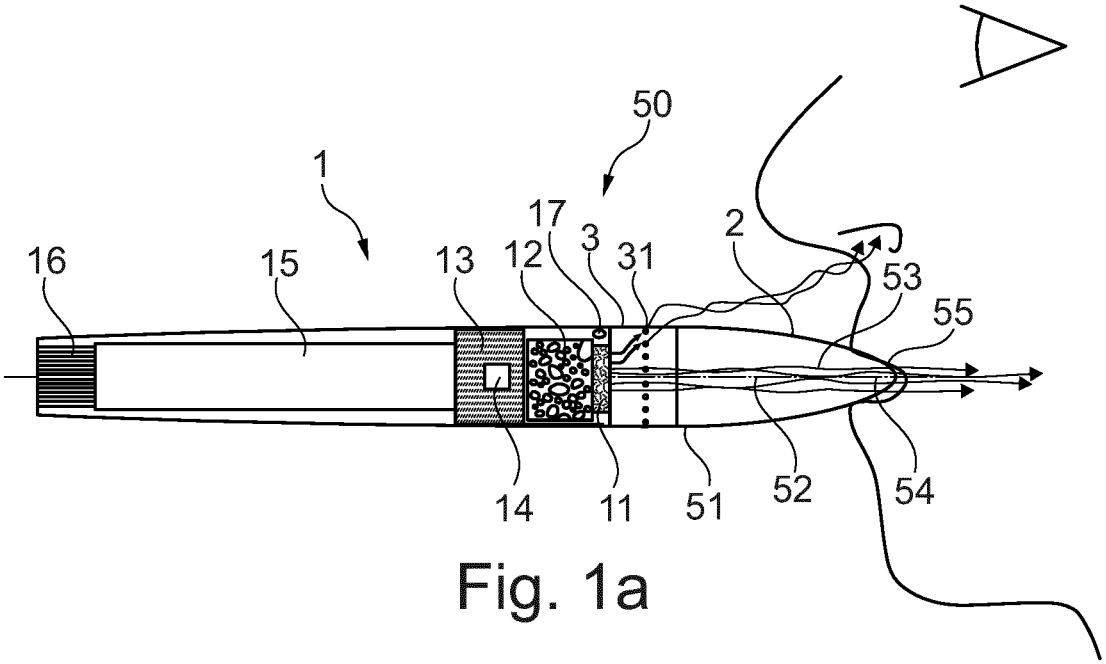
Figure 1B:
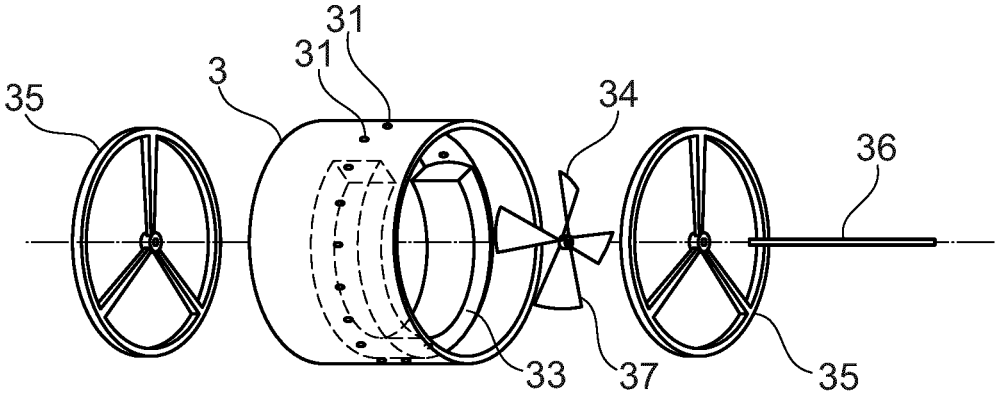
Figure 1C:
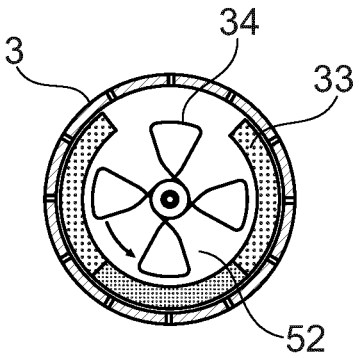
Figure 1D:
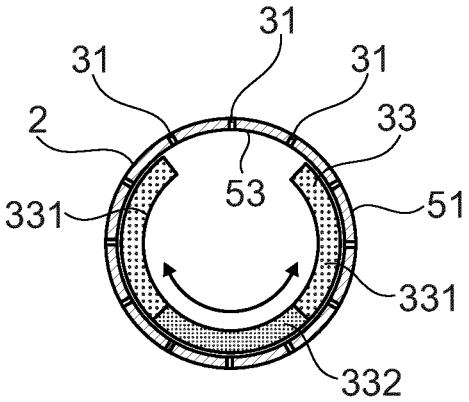

(51) Int. Cl.

| | |
|---|---|
| ***A24F 40/46*** | (2020.01) |
| ***A24F 40/48*** | (2020.01) |
| ***A24F 40/51*** | (2020.01) |

(56) References Cited

U.S. PATENT DOCUMENTS

| | | | |
|---|---|---|---|
| 2014/0096767 | A1 | 4/2014 | Pearson |
| 2015/0366250 | A1 | 12/2015 | Landau |
| 2019/0183183 | A1 | 6/2019 | Ito |

FOREIGN PATENT DOCUMENTS

| | | | |
|---|---|---|---|
| DE | 10 2018 100 949 | A1 | 7/2019 |
| EP | 3 504 988 | A1 | 7/2019 |
| GB | 2497536 | A | 6/2013 |
| GB | 2497616 | A | 6/2013 |
| JP | 8-56640 | A | 3/1996 |
| KR | 10-2014-0123487 | A | 10/2014 |
| KR | 10-2015-0145263 | A | 12/2015 |
| KZ | 31488 | B | 9/2016 |
| RU | 145 532 | U1 | 9/2014 |
| RU | 2 701 846 | C2 | 10/2019 |
| WO | WO 2013/093469 | A2 | 6/2013 |
| WO | WO 2018/037562 | A1 | 3/2018 |

OTHER PUBLICATIONS

Combined Russian Office Action and Search Report issued May 11, 2023 in Russian Patent Application No. 2022132231/03 (with English Translation of Office Action only), 10 pages.

Japanese Office Action issued Nov. 6, 2023 in Japanese Patent Application No. 2022-564563 (with English Translation), 7 pages.

International Search Report & Written Opinion issued Aug. 3, 2021 in PCT/EP2021/062138, filed on May 7, 2021, 16 pages.

International Preliminary Report on Patentability issued Jun. 7, 2022 in PCT/EP2021/062138, filed on May 7, 2021, 16 pages.

Korean Notice of Allowance issued Feb. 24, 202 in Korean Patent Application No. 10-2022-7042393 (with English Translation), 4 pages.

CARTRIDGE FOR AN AEROSOL GENERATING DEVICE

The present disclosure relates to a cartridge for an aerosol generating device and an aerosol generating device with such a cartridge. The aerosol generating device can be understood as a smoking system having a liquid storage portion. The present disclosure further relates to a method for splitting an airflow in a cartridge for an aerosol generating device and a manufacturing method for such a cartridge.

In the prior art, for example EP2493341A1 discloses a smoking system comprising a capillary wick for holding liquid, at least one air inlet, at least one air outlet, a chamber between the air inlet and air outlet, and at least one heater for heating the liquid in at least a portion of the capillary wick to form the aerosol. The air inlet, the air outlet and the chamber are arranged so as to define an air flow route from the air inlet to the air outlet via the capillary wick so as to convey aerosol formed from the liquid to the air outlet. The smoking system further includes at least one guide for channeling the air flow in the air flow route.

Electrically heated smoking systems or aerosol generating devices of the prior art do have a number of advantages, but there is still room for improvement in particular in view of a potential lack of aromatic notes and flavoring aspects when compared with a standard performance of conventional smoking articles, namely conventional cigarettes and cigars.

It is therefore an object of the invention to provide an improved cartridge for an aerosol generating device.

The object of the present disclosure is solved by the subject-matters of the independent claims, wherein further embodiments are incorporated in the dependent claims. It should be noted that the aspects of the disclosure described in the following apply to the cartridge for an aerosol generating device, the aerosol-generating device, the method for splitting an airflow in the cartridge and a manufacturing method for such a cartridge.

According to an aspect of the present disclosure, there is provided a cartridge for an aerosol generating device. The cartridge comprises a mouthpiece body with an outer surface and an inner air channel.

The inner air channel comprises an air channel inner surface and a mouthpiece opening at a mouth end of the inner air channel.

The mouthpiece body comprises a plurality of nasal airflow passages, which extend from the air channel inner surface to the outer surface of the mouthpiece body.

The present cartridge for an aerosol generating device allows a better performance in view of aromatic notes and flavoring aspects compared to conventional electrically heated smoking systems. The aromatic notes and flavoring aspects may be as good as for conventional cigarettes and cigars. This may ease a change of a user from conventional cigarettes and cigars to aerosol generating devices.

The aromatic notes and flavoring aspects are improved, because a flow of aerosol is not only provided by the mouthpiece opening at the mouth end of the cartridge, delivering aerosol to the user's mouth, but also by the plurality of nasal airflow passages, which deliver aerosol to the user's nose.

The cartridge can be understood as a preferably replaceable mouthpiece for an aerosol generating device. The cartridge comprises a reservoir configured for containing a liquid. The cartridge further comprises an aerosol generator as a heater configured for heating the reservoir and/or the liquid to form aerosol. The cartridge may be reversibly connectable to a power unit (e.g. a battery pack), wherein the power unit provides power to the aerosol generator. In use, the liquid in the reservoir may be vaporized by the heater to form a supersaturated vapor. The supersaturated vapor may be mixed with and carried in an air flow. The air flow flows from a distal position or end to a proximal position or end, with the proximal position being the mouth end or the mouthpiece opening of the device. The air flow may enter the device at the distal position. During the flow, the vapor may condense to form an aerosol and the aerosol may be carried towards a mouth of a user.

The mouthpiece body might be, for example, a cylindrical body with a circular cross section and a cylindrical outer surface. Also other shapes are possible.

The outer surface of the mouthpiece body can be understood as an exterior, lateral and/or circumferential surface of the mouthpiece body of the cartridge.

The inner air channel can be understood as a channel configured to guide a flow of aerosol through the cartridge and to a user. The inner air channel may extend at least partially through the mouthpiece body and/or the mouthpiece opening in a longitudinal direction. The inner air channel may be surrounded by the mouthpiece body.

The mouth end and/or the mouthpiece opening can be understood to be configured to be inserted into a user's mouth.

The mouthpiece opening can be arranged at an end of the mouthpiece body. The mouthpiece opening can be understood as an outlet of the inner air channel in a front face of the mouth end of the inner air channel.

The front face of the mouthpiece body can be understood as different to the outer surface of the mouthpiece body. The front face may extend essentially perpendicular the outer surface of the mouthpiece body.

The plurality of nasal airflow passages can be understood as more than one, preferably several nasal airflow passages. The plurality of nasal airflow passages can be understood as apertures in the outer surface of the cartridge that allow for fluid flow from the inner air channel to the exterior of the cartridge, at a location that is distal to the mouthpiece opening. The plurality of nasal airflow passages may radially extend from the inner air channel.

The plurality of nasal airflow passages can be arranged in an ordered group. The plurality of nasal airflow passages can be distributed along a circumference of the outer surface of the mouthpiece body. The plurality of nasal airflow passages can be arranged in shape of at least a ring surrounding the outer surface of the mouthpiece body. The plurality of nasal airflow passages can be arranged in shape of a spiral surrounding the outer surface of the mouthpiece body. A distance between adjacent nasal airflow passages can be continuous or discontinuous. Each nasal airflow passage may have a circular form or cross section, but also other shapes are possible. The nasal airflow passages may have the same of different forms and sizes.

In an embodiment, at least one of the nasal airflow passages may be configured to be accessible to a nose of the user. This can be understood in that the nasal airflow passages are arranged distal to the mouthpiece opening so that the mouthpiece opening is accessible to a mouth of the user and the nasal airflow passages are accessible to a nose of the user. As a result, a flow of aerosol can not only be configured to be provided by the mouthpiece opening to the mouth of a user, but also by the nasal airflow passages to the nose of the user. Because the aerosol is accessible to, or delivered to, the nose of a user, in addition to the mouth of a user, the user is able to smell, as well as taste the aerosol provided by the device. By delivering aerosol to the user's nose as well as the user's mouth, the present cartridge provides an enhanced experience, including both smell and taste, of the aromatic notes and flavoring aspects of the aerosol delivered by the cartridge.

In an embodiment, the plurality of nasal airflow passages may be spaced apart from the mouthpiece opening. This can be understood in the nasal airflow passages are not the same as the mouthpiece opening and/or are not arranged at the same position as the mouthpiece opening, but have a distance to the mouthpiece opening. In embodiments, the nasal airflow passages are distal to the mouthpiece opening. As a result, the flow of aerosol can be divided and configured to be provided separately to the mouth and to the nose of the user. Therefore, the present cartridge allows a very good performance in view of aromatic notes and flavoring aspects.

According to the aspect, the mouthpiece opening is an outlet configured for a first part of a flow of aerosol accessible to a mouth of the user. At least one of the nasal airflow passages is an outlet configured for a second part of the flow of aerosol accessible to a nose of the user. This can be understood in that an overall flow of aerosol can be divided into the first part and the second part and these two parts are configured to be provided separately to the mouth and to the nose. As a result, in an embodiment, the cartridge delivers aromatic notes and flavoring aspects to both the mouth and the nose of the user.

In an embodiment, the mouthpiece opening and at least one of the nasal airflow passages may be dimensioned so that the first part of the flow of aerosol is larger than the second part of the flow of aerosol. This can be understood in that a surface of the mouthpiece opening is larger than a surface of the nasal airflow passage(s) in use, which means a volume of the flow of aerosol configured to exit the mouthpiece opening is larger than a volume of the flow of aerosol configured to exit the nasal airflow passages. As a result, a larger portion of the flow of aerosol can be configured to exit the mouthpiece opening and enter the mouth of the user. This is beneficial, because the aerosol may deliver active ingredients, such as, for example nicotine, to the lungs of the user via the mouth of the user.

In an embodiment, the mouthpiece body may further comprise an inner member. The inner member may be arranged at the mouthpiece body. The inner member may be arranged inside the mouthpiece body. The inner member may be arranged inside a holder, which might an additional component attached to the mouthpiece body. The inner member may be arranged at the position of the plurality of nasal airflow passages. The inner member may be rotatable relative to the mouthpiece body, the holder and the nasal airflow passages. The inner member may selectively block one or more of the plurality of nasal airflow passages.

This can be understood in that the inner member may be rotatable relative to the mouthpiece body and the nasal airflow passages by means of gravity so that the inner member covers at least one of the nasal airflow passages at a lower part of the mouthpiece body and leaves open at least one other of the nasal airflow passages at an upper part of the mouthpiece body. The left open nasal airflow passage(s) at the upper part of the mouthpiece body may then be configured to have the open nasal airflow passage(s) accessible to the nose of the user. In other words, the moveable inner member may allow to block at least one nasal airflow passage and to leave open the other nasal airflow passages. Further, the moveable inner member may allow automatically leaving the nasal airflow passage open, which is on an upper part of the mouthpiece body and which is thereby configured to be accessible to the nose of the user.

This may allow reducing the portion of the aerosol flow assigned to the nose of the user and maintaining the portion of the aerosol flow assigned to the mouth at a maximum. In other words, no flow of aerosol may be "wasted" to nasal airflow passages, which are on the opposite side of the nose of the user and therefore not accessible to the nose. Furthermore, the moveable inner member may allow this function independent of a holding orientation of the cartridge by the user, because the inner member selectively blocks the nasal airflow passage that are on the opposite side of the cartridge from the nose of the user by means of gravity, automatically rotated into the correct position.

In an embodiment, the inner member may be arranged within the inner air channel. In other words, the nasal airflow passages may be blocked by the inner member from inside the inner air channel. This arrangement may lead to a compact device.

In another embodiment, the inner member may be arranged outside the mouthpiece body and the inner air channel. In other words, the nasal airflow passages may be blocked by the inner member from outside the mouthpiece body and the inner air channel. This arrangement may lead to a device, which is easy to repair and interesting to look at.

In an embodiment, the inner member may be arranged in a radial groove relative to the mouthpiece body. The radial groove may be arranged inside or outside the mouthpiece body and the inner air channel. The radial groove may allow a good guidance of the moveable inner member relative to the mouthpiece body.

In an embodiment, the inner member may be arranged in a rail relative to the mouthpiece body. The rail may be arranged inside or outside the mouthpiece body and the inner air channel. The rail may be arranged in the groove or directly at the mouthpiece body. The rail may allow a further improved guidance of the moveable inner member relative to the mouthpiece body.

In an embodiment, the inner member may be formed as an interrupted ring comprising a ring body and an at least partial interruption of the ring body. This may lead to the fact that the interrupted ring is lighter at the position of the interruption than at the position of the ring body, which means the inner member in form of the interrupted ring may automatically rotate by means of gravity relative to the mouthpiece body into a position in which the interruption is on the top side of the cartridge, accessible to the nose of a user. The interruption may further allow opening at least one of the nasal airflow passages on the upper part of the mouthpiece body, which is accessible for the nose. The ring body may block other nasal airflow passage(s). As a result, no flow of aerosol may be "wasted" to nasal airflow passage(s), which is/are not accessible to the nose regardless of a holding orientation of the cartridge by the user.

In another embodiment, the inner member may comprise two leg portions and a center portion. The center portion may be arranged between the two leg portions. The center portion may be configured to be heavier than each leg portion so that the center portion is moveable to a lower part of the mouthpiece body by means of gravity. Different materials of the components, different thicknesses, massive and hollow constructions and/or the like may implement the difference in weight. The difference in weight between the leg portions and the center portion may lead to the fact that the inner member may automatically rotate by means of gravity relative to the mouthpiece body into a position in which the center portion is in a downward direction. The center portion may allow blocking at least one of the nasal airflow passages on the lower part of the mouthpiece body, which is remote from the nose. The leg portions or parts of it or an interruption between the leg portions may open another nasal airflow passage(s). As a result, the flow of aerosol is limited to nasal airflow passage(s), which is/are accessible to the nose and this works independent of a holding orientation of the cartridge by the user.

In an embodiment, the cartridge may comprise at least one illumination unit. The illumination unit may be an LED, a screen, or the like. The illumination unit may provide light that is sensed by the user. In embodiments, the light may enhance the overall experience of the user. For example, if the aromatic notes and flavoring aspects are cooling, for example mint or menthol or eucalyptus flavor, the light may be a cool light, such as a blue light. This illumination may serve to enhance the user's perception of cooling aromatic notes and flavoring aspects of the taste and smell of the aerosol. In another example, if the aromatic notes and flavoring aspects are citrus, the light may be a yellow or orange light. This light may enhance the user's taste and smell perception of citrus aromatic notes and flavoring aspects. The illumination may be set by the user, or may be set according to the aromatic notes and flavoring aspects of the aerosol.

In additional embodiments, the illumination unit may be configured to signal an operational condition of the cartridge, on orientation of the cartridge relative to the ground and/or relative to a user, a taste of the aerosol, battery life, puff count, remaining liquid volume, time, remaining time, malfunction of the cartridge, status of the device, a temperature of the aerosol and/or the like.

In an embodiment, the mouthpiece body may further comprise at least one electrical contact arranged at an inner circumference of the mouthpiece body. The inner member may comprise an electrically conductive portion to close an electric circuit when the rotatable inner member is at a position where the electrically conductive portion contacts an electrical contact provided in the mouthpiece body. For example, the electric conductive portion may be provided in the center portion of the inner member. The cartridge may further comprise at least one illumination unit (a first illumination unit), which is configured to be supplied with electric energy when the electric circuit is closed. As a result, the illumination unit may be supplied with electric energy and thereby switched on depending on and in response to a position of the moveable inner member. Consequently, the illumination unit may be switched on depending on and in response to a position of the cartridge relative to the ground. This may be used to signal an e.g. preferred holding position to the user.

In an embodiment, there may be more than one illumination unit and either more than one electrical contact at the mouthpiece body or more than one electrically conductive portion at the rotatable inner member. As a result, an electric circuit between an electrical contact of the mouthpiece body and an electrically conductive portion of the rotatable inner member can be closed in more than one position. This may lead to the effect that selectively one of the more than one illumination units may be supplied with electric energy and thereby switched on depending on and in response to a position of the moveable inner member. This may be used for enlighten the illumination unit(s) facing the eyes of the user, while leaving other(s) dark to save energy.

In an embodiment, the illumination unit may be arranged at the moveable inner member. The illumination unit may be arranged at a front face of the inner member directed towards the mouthpiece opening. The illumination unit may be arranged at the ring body of the inner member adjacent to the interruption. The illumination unit may be arranged at one of the leg portions of the inner member adjacent to a free end of the leg portion.

Alternatively or additionally to the electrical contact at the mouthpiece body and electrically conductive portion at the rotatable inner member implementation above, the cartridge for an aerosol generating device may comprise a gyroscope sensor and a control unit. The gyroscope sensor may be configured to provide position data of the inner member to the control unit. The control unit may be configured to control an illumination of an illumination unit (a first illumination unit) based on the position data of the inner member. As a result, the illumination unit may be switched on depending on and in response to a position of the moveable inner member. Consequently, the illumination unit may be switched on depending on and in response to a position of the cartridge relative to the ground. This may be used to signal an e.g. preferred holding position to the user.

In an embodiment, the cartridge may comprise at least another illumination unit (a second illumination unit) and the control unit may be configured to control an illumination of the one of the two illumination units, which is more remote from a ground floor than the other based on the position data of the inner member. This means in case of more than one illumination unit, this may be used to enlighten only predefined illumination unit(s), as for example, the one(s) facing the eyes of the user, while leaving other(s) dark to save energy.

In an embodiment, the color of an illumination may be selectable by a user.

In an embodiment, the cartridge may comprise a color unit configured to control a color of an illumination. This can be additional or alternatively to the selection by the user mentioned above. The control of the color of illumination can be based on, for example, a type of aerosol generating substrate used in the aerosol generating device or the like.

In an embodiment, the cartridge may comprise a rotor element. The rotor element may be arranged within the mouthpiece body. The rotor element may be rotatable relative to the mouthpiece body. The rotor element may be configured to transport a part of the flow of aerosol radially in the direction of the nasal airflow passages. This can be done in that rotor blades of the rotor element and/or outer portions of the rotor blades are formed or designed to transport a part of the flow of aerosol radially in the direction of the nasal airflow passages. The transport of aerosol flow to the nasal airflow passages may therefore be more effective.

The rotor element may be arranged on a rotor shaft extending along a longitudinal direction of the mouthpiece body. The rotor shaft may extend along a central axis of the mouthpiece body.

The rotor element may be configured to be rotated by means of a puff of a user. This is very energy efficient, because it does not require an additional energy supply for e.g. a motor.

The rotor element may also be configured to be rotated by means of a motor. The motor may be an electric motor or the like. The motor may enable a stronger flow of aerosol.

As a summary, the cartridge according to the present disclosure may enhance an overall consumer experience, because it may deliver a portion of aerosol, including aromatic notes and flavoring aspects in a close proximity of a nose of a user, via one or more nasal airflow passages. In embodiments, the delivery of aerosol, including aromatic notes and flavouring aspects to a nose of a user is done independently of an orientation and general position of the cartridge. This means that a small part of the aerosol flow may be provided as aroma while a mouth of the user puffs a larger stream of the aerosol flow. Further, an aroma dispensing is driven by a puff of the user, meaning that only when the user puffs, the aroma dispensing takes place and corresponds of the frequency and intensity of the puffing. In addition, the aroma dispensing through the nasal airflow passage(s) may be assisted by a rotor element, a fan, driven either by the puff of the user or by an electrically driven motor.

Further, the cartridge according to the present disclosure may enhance an overall consumer experience by means of an illumination corresponding to an aroma/aerosol produced by the device. The illumination may provide information to the user. Also this illumination feature can be achieved independently of the orientation of the cartridge.

The cartridge according to the present disclosure may enhance the consumer experience without requiring extra or stronger flavourings in the content of the consumable. It simply takes the best of an existing content of the consumable by assuring that it reaches the smell sense of the user as an aromatic experience, while providing light also as a visual psychologic aspect that complements the overall sensorial experience.

According to another aspect of the present disclosure, also a manufacturing method for a cartridge is presented. The manufacturing method for a cartridge comprises the following steps, not necessarily in this order:

providing a mouthpiece body with an outer surface and an in inner air channel, wherein the inner air channel comprises an air channel inner surface and a mouthpiece opening at a mouth end of the inner air channel, and providing a plurality of nasal airflow passages, which extend from the air channel inner surface to the outer surface of the mouthpiece body.

The present manufacturing method for a cartridge allows manufacturing a cartridge with a better performance in view of aromatic notes and flavoring aspects compared to conventional electrically heated smoking systems. The aromatic notes and flavoring aspects may be as good as for conventional cigarettes and cigars. The aromatic notes and flavoring aspects are improved, because a flow of aerosol is not only provided by the mouthpiece opening of the cartridge, but also by the plurality of nasal airflow passages of the cartridge.

The manufacturing method may further comprise a step of providing an inner member, which is rotatable relative to the mouthpiece body and the nasal airflow passages by means of gravity. The moveable inner member may so automatically leave the nasal airflow passage open, which is on an upper part of the mouthpiece body and which is thereby accessible to the nose of the user. The moveable inner member may allow this function independent of a holding orientation of the cartridge by the user.

The manufacturing method may comprise the step of providing at least one illumination unit.

The manufacturing method may further comprise the steps of providing at least one electrical contact arranged at an inner circumference of the mouthpiece body and providing the inner member with an electrically conductive portion. As a result, an electric circuit can be closed when the rotatable inner member is at a position where the electrically conductive portion contacts an electrical contact to switch the illumination unit on depending on a position of the moveable inner member and therefore in response to a position of the cartridge relative to the ground. This may be used to signal an e.g. preferred holding position to the user.

Alternatively, the manufacturing method may further comprise the steps of providing more than one illumination unit and providing either more than one electrical contact at the mouthpiece body or providing more than one electrically conductive portion at the rotatable inner member. As a result, an electric circuit between the electrical contact and the electrically conductive portion of the rotatable inner member can be closed in more than one position. Consequently, one of the more than one illumination units may be switched on depending on a position of the moveable inner member. This may be used to enlighten the illumination unit(s) facing the eyes of the user, while leaving other(s) dark to save energy.

Alternatively, the manufacturing method may further comprise the steps of providing a gyroscope sensor and providing a control unit connected to the illumination unit. The gyroscope sensor may provide position data of the inner member to the control unit. The control unit may control an illumination of the illumination unit based on the position data of the inner member. As a result, the illumination unit may be switched on depending on a position of the moveable inner member and in response to a position of the cartridge relative to the ground. This may be used to signal an e.g. preferred holding position to the user.

The manufacturing method may further comprise the step of providing at least another illumination unit. The control unit may then control an illumination of the one of the at least two illumination units, which is more remote from a ground floor than the other based on the position data of the inner member. This may be used to enlighten only predefined illumination unit(s), as for example, the one(s) facing the eyes of the user, while leaving other(s) dark to save energy.

The manufacturing method may further comprise the step of providing a color unit to control a color of an illumination. The control of the color of illumination can be based on, for example, a type of aerosol generating substrate used in the aerosol generating device or the like.

The manufacturing method may further comprise the step of providing a rotor element arranged within the mouthpiece body. The rotor element may rotate relative to the mouthpiece body and transport a part of the flow of aerosol radially in the direction of the nasal airflow passages. The transport of aerosol flow may therefore be more effective.

Below, there is provided a non-exhaustive list of non-limiting examples. Any one or more of the features of these examples may be combined with any one or more features of another example, embodiment, or aspect described herein.

A. A cartridge for an aerosol generating device, comprising a mouthpiece body with an outer surface and an in inner air channel, wherein the inner air channel comprises an air channel inner surface and a mouthpiece opening at a mouth end of the inner air channel, and wherein the mouthpiece body comprises a plurality of nasal airflow passages, which extend from the air channel inner surface to the outer surface of the mouthpiece body.

B. Cartridge according to claim A, wherein at least one of the nasal airflow passages is configured to be accessible to a nose of the user.

C. Cartridge according to one of the preceding claims, wherein the plurality of nasal airflow passages are spaced apart from the mouthpiece opening.

D. Cartridge according to one of the preceding claims, wherein the mouthpiece opening is an outlet configured for a first part of a flow of aerosol accessible to a mouth of the user, and at least one of the nasal airflow passages is an outlet configured for a second part of the same flow of aerosol accessible to a nose of the user.

E. Cartridge according to the preceding claim, wherein the mouthpiece opening and at least one of the nasal airflow passages are dimensioned so that the first part of the flow of aerosol is larger than the second part of the flow of aerosol.

F. Cartridge according to one of the preceding claims, wherein the mouthpiece body further comprises an inner member.

G. Cartridge according to the preceding claim, wherein the inner member is arranged at the position of the plurality of nasal airflow passages.

H. Cartridge according to one of the claims F or G, wherein the inner member is rotatable relative to the mouthpiece body and the nasal airflow passages.

I. Cartridge according to one of the claims F to H, wherein the inner member selectively blocks one or more of the plurality of nasal airflow passages.

J. Cartridge according to one of the claims F to I, wherein the inner member is rotatable relative to the mouthpiece body and the nasal airflow passages by means of gravity so that the inner member covers at least one of the nasal airflow passages at a lower part of the mouthpiece body and leaves open at least one other of the nasal airflow passages at an upper part of the mouthpiece body, configuring the at least one open nasal airflow passage to be accessible to a nose of the user.

K. Cartridge according to one of the claims F to J, wherein the inner member is arranged within the inner air channel.

L. Cartridge according to one of the claims F to J, wherein the inner member is arranged outside the mouthpiece body.

M. Cartridge according to one of the claims F to L, wherein the inner member is arranged in a radial groove relative to the mouthpiece body.

N. Cartridge according to one of the claims F to M, wherein the inner member is arranged in a rail relative to the mouthpiece body.

O. Cartridge according to one of the claims F to N, wherein the inner member is formed as an interrupted ring comprising a ring body and an at least partial interruption of the ring body.

P. Cartridge according to one of the claims F to O, wherein the inner member comprises two leg portions and a center portion, wherein the center portion is arranged between the two leg portions, and wherein the center portion is heavier than each leg portion so that the center portion is moveable to a lower part of the mouthpiece body by means of gravity.

Q. Cartridge according to one of the claims F to P, wherein the mouthpiece body further comprises at least one electrical contact arranged at an inner circumference of the mouthpiece body.

R. Cartridge according to the preceding claim, wherein the inner member comprises an electrically conductive portion to close an electric circuit when the rotatable inner member is at a position where the electrically conductive portion contacts an electrical contact provided in the mouthpiece body.

S. Cartridge according to the preceding claim, wherein the electric conductive portion is provided in the center portion of the inner member.

T. Cartridge according to claim R or S, further comprising at least one illumination unit, which is configured to be supplied with electric energy when the electric circuit is closed.

U. Cartridge according to the preceding claim, wherein the illumination unit is arranged at the moveable inner member.

V. Cartridge according to one of the claims T or U, wherein the illumination unit is arranged at a front face of the inner member directed towards the mouthpiece opening.

W. Cartridge according to one of the claims T or U, wherein the illumination unit is arranged at the ring body of the inner member adjacent to the interruption.

X. Cartridge according to one of the claims T or U, wherein the illumination unit is arranged at one of the leg portions of the inner member adjacent to a free end of the leg portion.

Y. Cartridge according to one of the claims A to S, further comprising a gyroscope sensor, a control unit and an illumination unit, wherein the gyroscope sensor is configured to provide position data of the inner member to the control unit, and wherein the control unit is configured to control an illumination of the illumination unit based on the position data of the inner member.

Z. Cartridge according to the preceding claim, wherein the cartridge comprises at least another illumination unit, and the control unit is configured to control an illumination of the one of the two illumination units, which is more remote from a ground floor than the other based on the position data of the inner member.

AA. Cartridge according to one of the claims T to Z, wherein a color of an illumination is selectable by a user.

BB. Cartridge according to one of the claims T to AA, further comprising a color unit configured to control a color of an illumination based on a type of aerosol generating substrate used in the aerosol generating device.

CC. Cartridge according to one of the preceding claims, further comprising a rotor element, which is arranged within the mouthpiece body and which is rotatable relative to the mouthpiece body.

DD. Cartridge according to the preceding claim, wherein the rotor element is arranged on a rotor shaft extending along a longitudinal direction of the mouthpiece body.

EE. Cartridge according to the preceding claim, wherein the rotor shaft extends along a central axis of the mouthpiece body.

FF. Cartridge according to one of the claims CC to EE, wherein the rotor element is configured to be rotated by means of a puff of a user.

GG. Cartridge according to one of the claims CC to FF, wherein the rotor element is configured to be rotated by means of a motor.

HH. Cartridge according to one of the claims CC to GG, wherein the rotor element comprises rotor blades, and wherein outer portions of the rotor blades are configured to transport a part of the flow of aerosol radially in the direction of the nasal airflow passages.

II. Cartridge according to one of the claims CC to HH, wherein the mouthpiece body further comprises a holder arranged within the inner air channel, wherein the inner member is rotatable relative to the holder.

JJ. A method for splitting an airflow in a cartridge for an aerosol generating device, comprising:

providing a cartridge according to one of the claims A to II, providing a flow of aerosol through an air channel of the cartridge, splitting the flow of aerosol in a first part directed to a mouthpiece opening of the cartridge, and splitting the flow of aerosol in a second part directed to at least one of a plurality of nasal airflow passages of the cartridge.

KK. A manufacturing method for a cartridge, comprising:

providing a mouthpiece body with an outer surface and an in inner air channel, wherein the inner air channel comprises an air channel inner surface and a mouthpiece opening at a mouth end of the inner air channel, and providing a plurality of nasal airflow passages, which extend from the air channel inner surface to the outer surface of the mouthpiece body.

Examples will now be further described with reference to the figures in which:

FIGS. 1*a-d* show schematically and exemplarily an embodiment of d a cartridge for the aerosol generating device according to the disclosure.

Figure 2A:
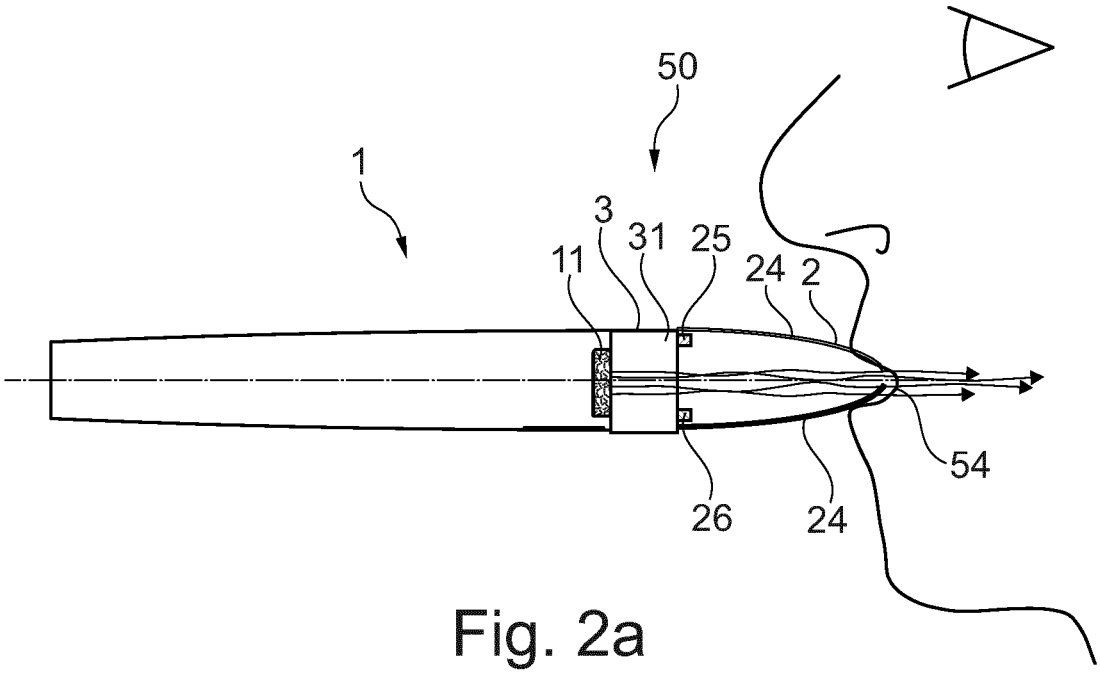
Figure 2B:
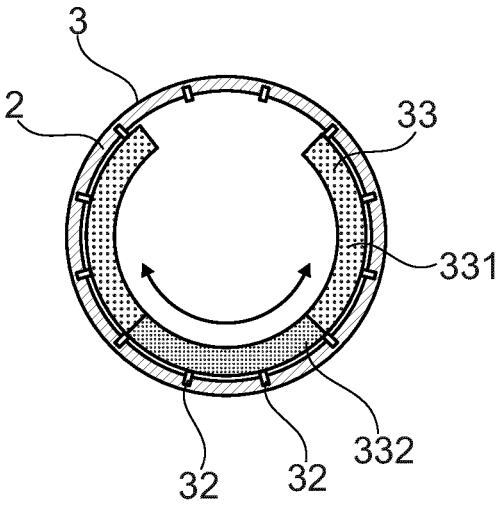
Figure 2C:
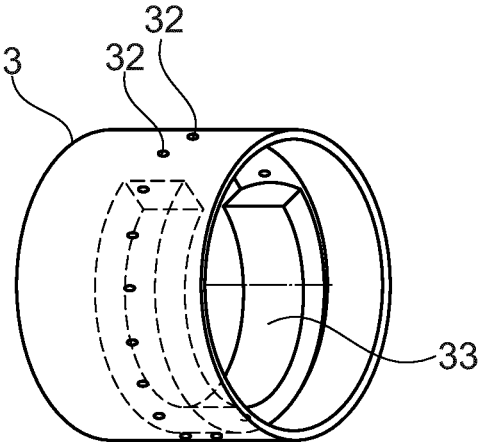

FIGS. 2*a-c* show schematically and exemplarily a further embodiment of a cartridge for the aerosol generating device according to the disclosure.

Figure 3A:
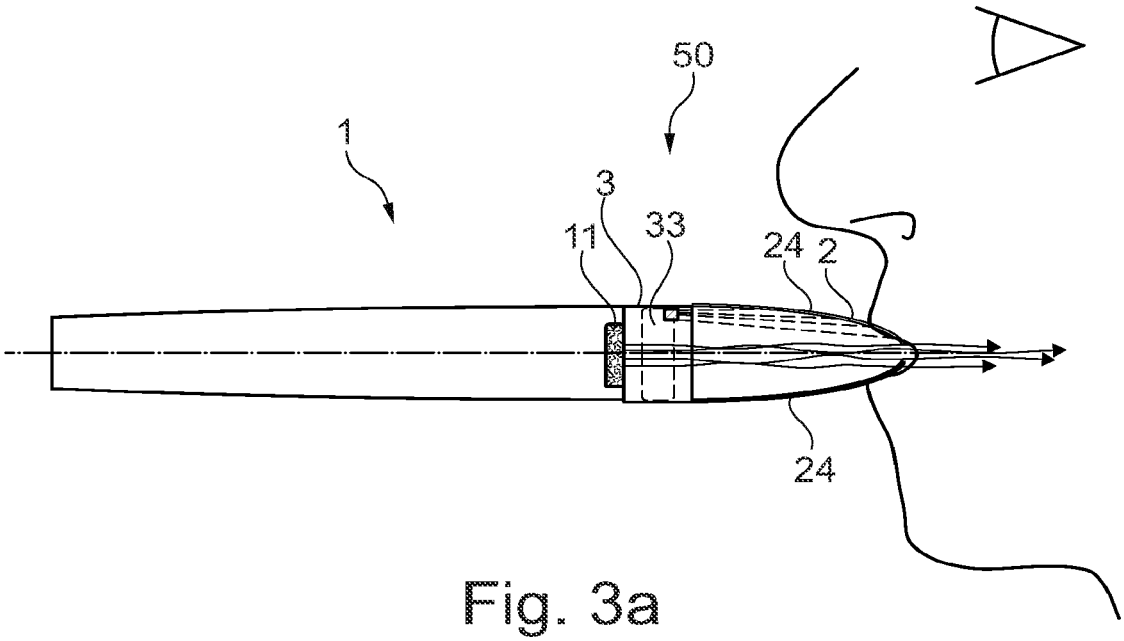
Figure 3B:
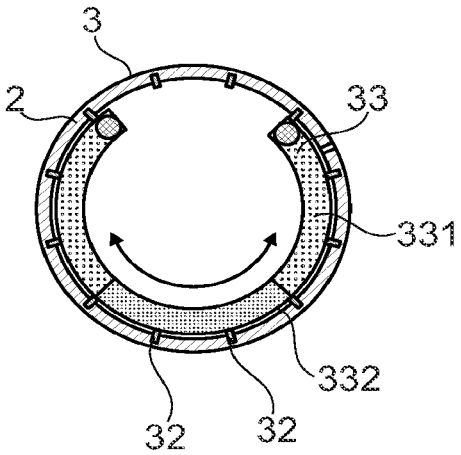
Figure 3C:
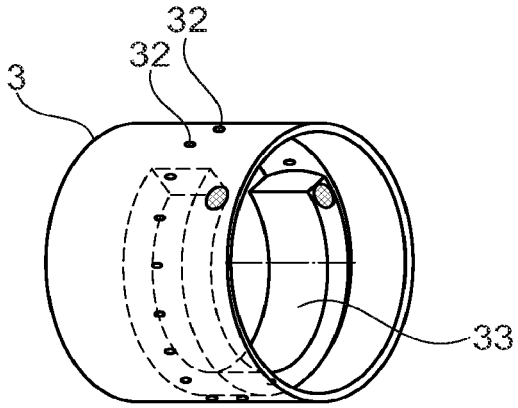
Figure 4A:
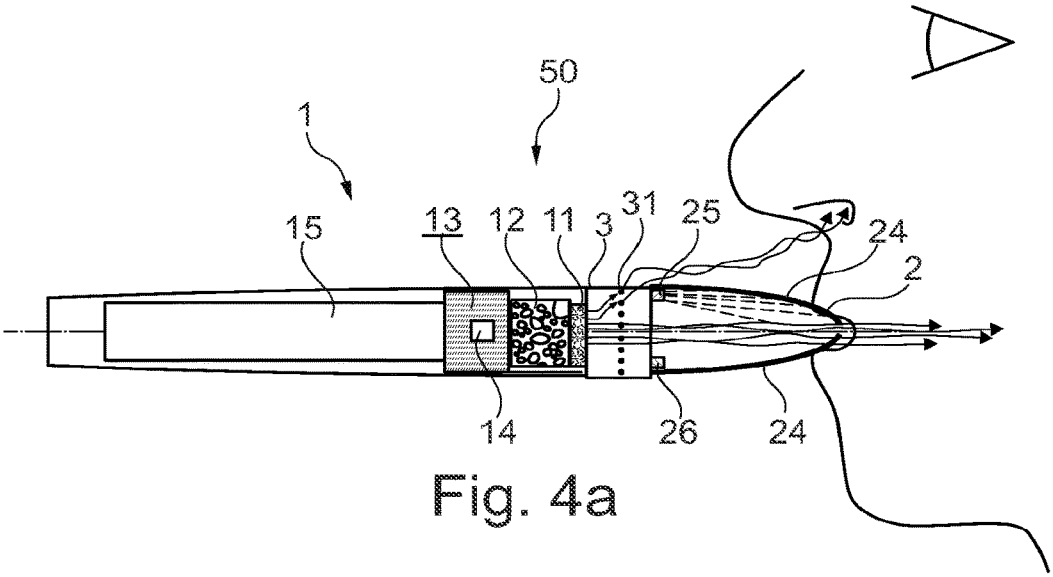
Figure 4B:
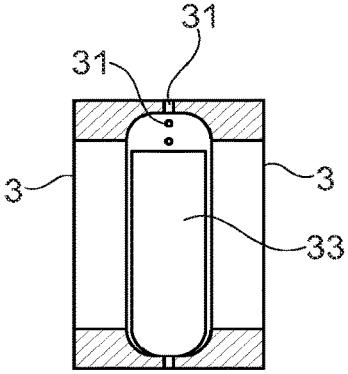
Figure 4C:
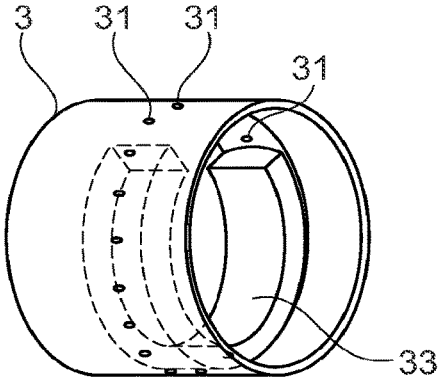
Figure 4D:
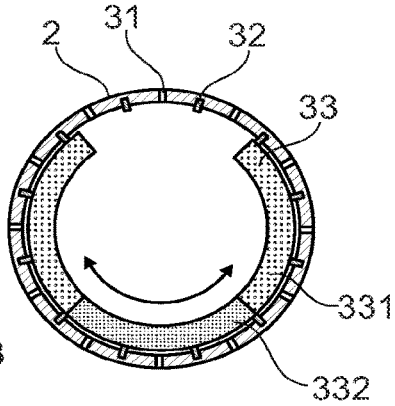
Figure 4E:
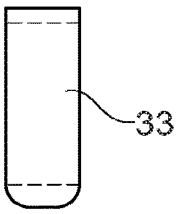
Figure 4F:
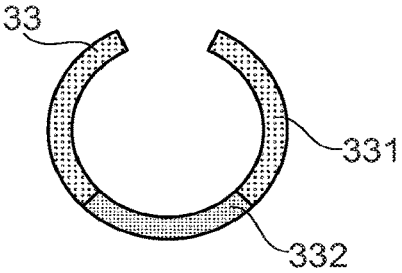
Figure 4G:
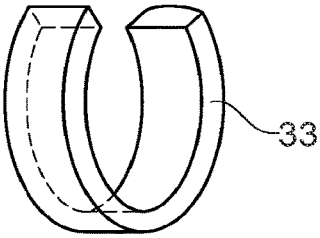

FIGS. 3*a-c* show schematically and exemplarily a further embodiment of a cartridge for the aerosol generating device according to the disclosure.

FIGS. 4*a-g* show schematically and exemplarily a further embodiment of a cartridge for the aerosol generating device according to the disclosure.

Figure 5A:
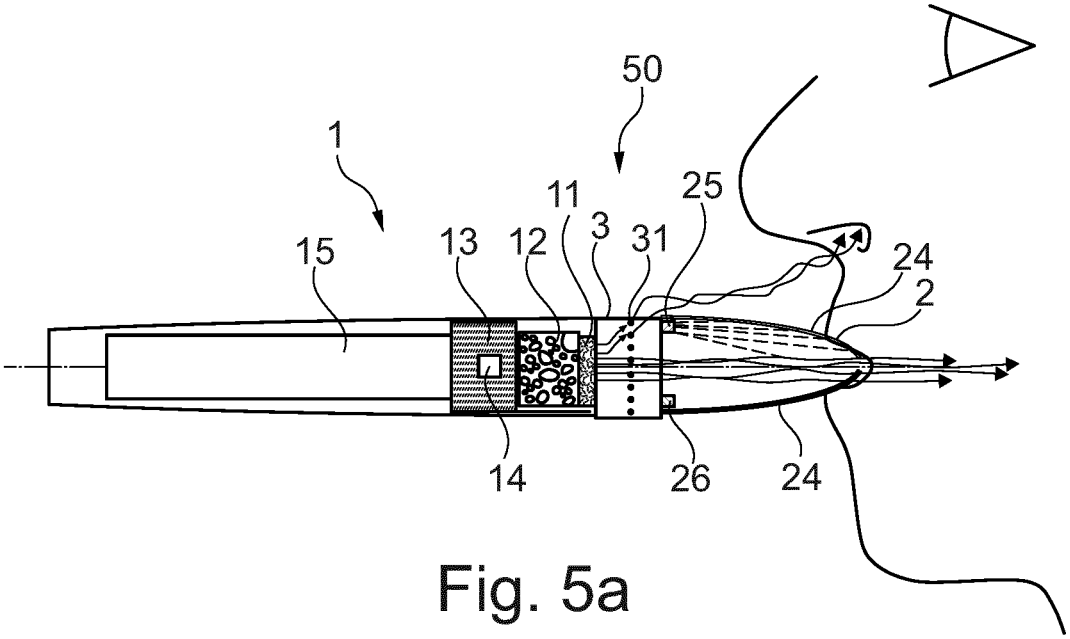
Figure 5B:
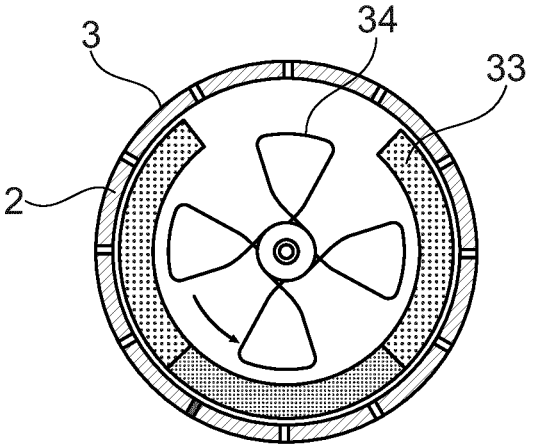

FIGS. 5*a-b* show schematically and exemplarily a further embodiment of a cartridge for the aerosol generating device according to the disclosure.

FIGS. 1*a-d* show schematically and exemplarily different representations of an embodiment of a cartridge 50 for an aerosol generating device 1 according to the disclosure. The cartridge 50 can be part of an aerosol generating device 1 or can be a replaceable module, which can be acquired separately by a user to be used in aerosol generating devices 1 using a modularity concept.

The cartridge 50 is here reversibly connected to a power source 15 (e.g. a battery) and a power and data connectivity port 16. The power source 15 may provide power to an aerosol generator. The power source 15 and the power and data connectivity port 16 are optional parts of the cartridge 50.

The cartridge 50 here comprises a reservoir 12 containing liquid. The cartridge 50 here also comprises an aerosol generator as a heater 11 for heating the liquid to form aerosol. The heater 11 can be a coil and wick heater or a ceramic element with a resistive heater (a strip of metal) embedded in or deposited on the ceramic where the ceramic functions as a wick to deliver liquid to the heating element. The heater 11 is at least partially arranged inside the reservoir 12.

In use, an air flow provided by a user's puff enters the cartridge 50 at a distal end and flows from the distal end across the heater 11 to a proximal end being a mouth end or a mouthpiece opening 54 of the cartridge 50. The liquid in the reservoir 12 is vaporized by the heater and carried by the air flow. During the air flow, the vapor condenses to form an aerosol and the aerosol is carried towards a mouth of a user. The reservoir 12 and the heater 11 are optional parts of the cartridge 50.

The cartridge 50 is a mouthpiece for the aerosol generating device 1. The cartridge comprises a mouthpiece body 2 with an outer surface 51 and an in inner air channel 52. The inner air channel 52 comprises an air channel inner surface 53 and a mouthpiece opening 54 at a mouth end 55 of the inner air channel 52.

The mouthpiece body 2 comprises a plurality of nasal airflow passages 31, which extend from the air channel inner surface 53 to the outer surface 51 of the mouthpiece body 2. The nasal airflow passages 31 are spaced apart from the mouthpiece opening 54.

The mouthpiece body 2 further comprises a moveable inner member 33 (e.g. a pendula) arranged within the inner air channel 52. The inner member 33 is rotatable relative to the mouthpiece body 2 and the nasal airflow passages 31. The nasal airflow passages 31 are small openings (of any geometry) and which are optionally closed or opened by means of the optional inner member 33.

The inner member 33 is here arranged inside an optional holder 3. The inner member 33 is rotatable relative to the holder 3, the mouthpiece body 2 and the nasal airflow passages 31 by means of gravity so that the inner member 33 covers at least one of the nasal airflow passages 31 at a lower part of the mouthpiece body 2 and leaves open at least one other of the nasal airflow passages 31 at an upper part of the mouthpiece body 2. The at least one other of the nasal airflow passages 31 at an upper part of the mouthpiece body 2 is accessible to a nose of a user.

The inner member 33 is formed as an interrupted ring comprising a ring body and an interruption of the ring body. The ring body comprises two leg portions 331 and a center portion 332, wherein the center portion 332 is arranged between the two leg portions 331. The center portion 332 is heavier than each leg portion 331 so that the center portion 332 is moveable to a lower part of the mouthpiece body 2 by means of gravity. The leg portions 331 can be, for example, be made of light polymeric material. The center portion 332 can be, for example, be made of a heavier metallic, electrically conductive alloy or metal. The inner member 33 may be arranged in a radial groove relative to the mouthpiece body with or without a rail.

The nasal airflow passages 31 may release part of the aerosol flow under the nose of the user, which may inhale this part of the aerosol flow via the nose, while another (larger) part of the aerosol flow exits the mouth opening 54 and is inhaled via the mouth of the user. This system assures that a release of a part of the aerosol flow occurs always in the region of the cartridge 50 under the nose of the user independently of an overall orientation of the cartridge 50 and independently of any potential movement of the cartridge 50 during the puff of the user.

In embodiments, the cartridge 50 further comprises a rotor element 34 (e.g. a fan or propeller), which is arranged within the mouthpiece body 2 and which is rotatable relative to the holder 3 and the mouthpiece body 2. The rotor element 34 is arranged on a rotor shaft 36 (e.g. an axial long pin) extending along a longitudinal direction of the holder 3 and the mouthpiece body 2. The rotor shaft 36 extends along a central axis of the mouthpiece body 2 in the middle of the inner air channel 52. The cartridge 50 further comprises at least one (here two) shaft holders 35, which may enclose the parts inside the holder 3 with very low resistance to an air flow.

The rotor element 34 may be rotated by means of an air flow caused by a puff of a user and/or by means of a motor (not shown). The rotor element 36 comprises rotor blades 37, which outer portions are configured to transport a part of the flow of aerosol radially in the direction of the nasal airflow passages 31. When a puff occurs, the rotor element 34 automatically rotates and the air flow is mainly axially in relation to the rotor shaft 36. In the periphery/edges of the rotor element 34 and the rotor blades 37, the air flow tends to be projected radially, towards the radial nasal airflow passages 31, which, if open, let a portion of the volume of the air flow pass to the exterior of the cartridge 50. This air flow radially exiting the cartridge 50 may then be inhaled by the user via the nose.

When the user puffs, the rotor element 34 rotates proportionally, meaning that the stronger the puff, the faster the rotor element 34 rotates. Due to a shape/design of the rotor element 34, some of the air or aerosol in a radial periphery of the rotor element 34 is moved radially outwards and therefore going towards the nasal airflow passages 31. Because the nasal airflow passages 31 are opened or closed by means of the inner member 33 that is driven by gravity as described above, and has an opening (the interruption of the ring body) which is oriented at the top of the mouthpiece body 2, the nasal airflow passages 31 oriented at the top of the mouthpiece body 2 are not blocked by the inner member 33, and aerosol is moved out of the nasal airflow passages 31 oriented at the top of the mouthpiece body 2, in the direction of a nose of a user.

FIGS. 2*a-c* show schematically and exemplarily different components of an aerosol generating device 1 and a cartridge 50 for the aerosol generating device 1 according to the disclosure. The cartridge 50 may enhance a sensorial experience of a user because the user activates the above-explained internal components of the cartridge 50 when puffing, which radially deviate part of the aerosol flow towards the nasal airflow passages 31 in the portion of the cartridge 50 under the nose of the user.

Additionally, when operating the cartridge 50, visible light may be activated in the same portion of the cartridge 50, which may increase its intensity the stronger the user puffs and/or such light may remain active still after some time after the end of the puff. This may further enhance the sensorial experience of the user as explained in the following.

The cartridge 50 comprises (additionally to the components of FIG. 1) illumination units 25, 26. The illumination units 25, 26 are arranged at the moveable inner member 33, and in particular at a front face of the inner member 33 directed towards the mouthpiece opening 54. In embodiments, the illumination units 25, 26 may protrude from the top surface of the mouthpiece body 2. As a result, the light of the illumination units 25, 26 may be automatically applied in a region of the cartridge close to a face of the user, and in particular close to her or his eyes.

The illumination units 25, 26 may be lights and in particular LED or OLED low consumption lights. In the area of the illumination units 25, 26, walls 24 of the mouthpiece body 2 may be totally or partially transparent or translucent. The visible light of the illumination units 25, 26 may change its colour according to a type of consumable flavour. Different types of flavours (and aromas) may correspond to different colours as the same LED can switch the colour of its light by means of a control unit. The control unit can automatically detect the type of consumable and/or a user may select the colour to be applied according to the colour corresponding to the type of consumable or selecting a colour of its preference.

The mouthpiece body 2 further comprises, for example, metallic electrical contacts 32 arranged at an inner circumference of the mouthpiece body 2.

The inner member 33 further comprises a, for example, metallic electrically conductive portion 332 to close an electric circuit when the rotatable inner member 33 is at a position where the electrically conductive portion 332 contacts an electrical contact 32 provided in the mouthpiece body 2.

The inner member 33 can be considered as a gravity switch for the electrical contacts 32. The small electrical contacts 32 of the mouthpiece body 2 can be considered as sliding contacts for a pendula movement of the inner member 33. By means of the movement of the inner member 33, its electrically conductive portion 332 establishes an electrical contact between some of the electrical contacts 32, which in turn activate one of the illumination units 25, 26. In other words, when an electric circuit between the electrically conductive portion 332 and the electrical contact 32 is closed, at least some of the illumination units 25, 26 are supplied with electric energy and are switched on. As a result, light will illuminate in a predefined (e.g. upper) position based on the orientation of the cartridge 50 as defined anytime by the moveable inner member 33.

FIGS. 3*a-c* show schematically and exemplarily different components of an aerosol generating device 1 and a cartridge 50 for the aerosol generating device 1 according to the disclosure. The illumination units 25, 26 are again arranged at the moveable inner member 33, but in contrast to the embodiment of FIG. 2, they are integrated into the ring body of the inner member 33, and may be flush with the ring body and not protruding therefrom. The illumination units 25, 26 are arranged at the ring body adjacent to the interruption, and in particular at the leg portions 331 of the inner member 33 adjacent to the respective free ends of the leg portions 331. The illumination units 25, 26 are again directed towards the mouthpiece opening 54. As for FIG. 2, the light of the illumination units 25, 26 may be automatically applied in an upper region of the cartridge 50, which is closer to a face of the user, and in particular closer to her or his eyes, than a lower region of the cartridge 50.

FIGS. 4*a-g* and 5*a-b* show schematically and exemplarily different representations and components of further embodiments of an aerosol generating device 1 and a cartridge 50 for the aerosol generating device 1 according to the disclosure. The cartridge 50 comprises a gyroscope sensor 14 and a control unit 13. The gyroscope sensor 14 provides position data of the inner member 33 to the control unit 13. The control unit 13 controls an illumination of the illumination units 25, 26 based on the position data of the inner member 33. The control unit 13 may control an illumination of the one of the two illumination units 25, 26, which is more remote from a ground floor than the other based on the position data of the inner member 33. As a result, the illumination units 25 or 26 will be switched on, which is in a vertical position towards the top. In addition, the control unit may control power provided by the battery to the heater. The controller may further receive exchange signals with, for example, a temperature sensor, a pressure sensor, a puff counter, a timer, or other sensors.

As a summary, the cartridge according to the present disclosure may enhance an overall consumer experience, because it may deliver an aroma as a small portion of the aerosol flow to nasal airway passages on the top surface of the cartridge. The top surface of the cartridge is in a close proximity of a nose of a user. The device may provide this aerosol flow the top surface of the cartridge, where the location of the "top surface" of the cartridge is determined by the inner member and is based on gravity, and so is independent of an orientation and general position of the cartridge. This means that a small part of the aerosol flow may be provided as aroma to the nose of a user while a mouth of the user puffs a larger stream of the aerosol flow. Further, aroma dispensing can be driven by a puff of the user, meaning that only when the user puffs, the aroma dispensing takes place and corresponds to the frequency and intensity of the puffing.

Further, the cartridge according to the present disclosure may enhance an overall consumer experience by means of an illumination corresponding to an aroma/aerosol produced by the device. Also this feature can be achieved independently of the orientation of the cartridge.

The cartridge according to the present disclosure may enhance the consumer experience without requiring extra or stronger flavourings in the content of the consumable. It simply takes the best of an existing content of the consumable by assuring that it reaches the smell sense of the user as an experience of smell, while providing light also as a visual psychologic aspect that complements the overall sensorial experience.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A ±20% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed disclosure. Also, all ranges include the maximum and minimum points disclosed and include any intermediate ranges therein, which may or may not be specifically enumerated herein.

Although illustrative examples of the present disclosure have been described above, in part with reference to the accompanying drawings, it is to be understood that the disclosure is not limited to these examples. Variations to the disclosed examples can be understood and effected by those skilled in the art in practicing the disclosure, from a study of the drawings, the specification and the appended claims.

In the claims, any reference signs placed between parentheses shall not be construed as limiting the claim. The term "comprising" does not exclude the presence of elements or steps other than those listed in a claim. The word "a" or "an" preceding an elements does not exclude the presence of a plurality of such elements. The disclosure can be implemented by means of hardware comprising several distinct elements. In the device claim enumerating several means, several of these means can be embodied by one and the same item of hardware. The mere fact that certain measured are recited in mutually different dependent claims does not indicate that a combination of these measure cannot be used to advantage.

The invention claimed is:

1. A cartridge for an aerosol-generating device, comprising:

a mouthpiece body with an outer surface and an inner air channel;

an aerosol generator; and a liquid reservoir, wherein the aerosol generator is a heater configured to heat liquid from the liquid reservoir to form an aerosol, wherein the inner air channel comprises an air channel inner surface and a mouthpiece opening at a mouth end of the inner air channel, the mouthpiece opening being an outlet configured for a first part of a flow of the aerosol accessible to a mouth of a user, wherein the mouthpiece body comprises a plurality of nasal airflow passages, which extend from the air channel inner surface to the outer surface of the mouthpiece body, wherein at least one of the nasal airflow passages is an outlet configured for a second part of the flow of the aerosol accessible to a nose of the user as aroma, wherein the cartridge is configured to dispense the aroma through the at least one of the nasal airflow passages driven by a puff of the user and corresponding to a frequency and an intensity of the puff, wherein an overall air flow entering the cartridge with the puff of the user is divided within the cartridge into the first part of the flow of the aerosol accessible to a mouth of the user and the second part of the flow of the aerosol accessible to a nose of the user, and wherein the first part and the second part of the flow of aerosol are provided separately to the mouth and the nose of user.

2. The cartridge according to claim 1, wherein the plurality of nasal airflow passages extend radially from the inner air channel.

3. The cartridge according to claim 1, wherein the plurality of nasal airflow passages are spaced apart from the mouthpiece opening.

4. The cartridge according to claim 1, wherein the plurality of nasal airflow passages are distal to the mouthpiece opening.

5. The cartridge according to claim 1, wherein the mouthpiece body further comprises an inner member arranged within the inner air channel, and wherein the inner member is rotatable relative to the mouthpiece body and the nasal airflow passages.

6. The cartridge according to claim 5, wherein the inner member selectively blocks one or more of the plurality of nasal airflow passages.

7. The cartridge according to claim 5, wherein the inner member is rotatable relative to the mouthpiece body and the nasal airflow passages by means of gravity so that the inner member covers at least one of the nasal airflow passages at a lower part of the mouthpiece body and leaves open at least one other of the nasal airflow passages at an upper part of the mouthpiece body, configuring the at least one open nasal airflow passage to be accessible to the nose of the user.

8. The cartridge according to claim 5, wherein the inner member is formed as an interrupted ring comprising a ring body and an at least partial interruption of the ring body.

9. The cartridge according to claim 5, wherein the inner member comprises two leg portions and a center portion, wherein the center portion is arranged between the two leg portions, and wherein the center portion is heavier than each leg portion so that the center portion is moveable to a lower part of the mouthpiece body by means of gravity.

10. The cartridge according to claim 5, wherein the mouthpiece body further comprises a holder arranged within the inner air channel, and wherein the inner member is rotatable relative to the holder.

11. The cartridge according to claim 5, wherein the mouthpiece body further comprises at least one electrical contact arranged at an inner circumference of the mouthpiece body.

12. The cartridge according to claim 11, wherein the inner member comprises an electrically conductive portion configured to close an electric circuit when the rotatable inner member is at a position where the electrically conductive portion contacts an electrical contact provided in the mouthpiece body.

13. The cartridge according to claim 12, further comprising at least one illumination unit, which is configured to be supplied with electric energy when the electric circuit is closed.

14. The cartridge according to claim 1, further comprising a rotor element, which is arranged within the mouthpiece body and which is rotatable relative to the mouthpiece body.

15. A method for splitting an airflow in a cartridge for an aerosol-generating device, the method comprising:

providing a cartridge according to claim 1;

providing a flow of aerosol through the air channel of the cartridge;

splitting the flow of aerosol into a first part directed to the mouthpiece opening of the cartridge; and splitting the flow of aerosol into a second part directed to said at least one of the plurality of nasal airflow passages of the cartridge.

* * * * *